United States Patent [19]

Shimizu

[11] 4,353,511

[45] Oct. 12, 1982

[54] ROLL-PAPER SETTING MECHANISM

[75] Inventor: Masahiro Shimizu, Kashihara, Japan

[73] Assignee: Sharp Kabushiki Kaisha, Osaka, Japan

[21] Appl. No.: 173,882

[22] Filed: Jul. 31, 1980

[30] Foreign Application Priority Data

Aug. 21, 1979 [JP] Japan ..... 54-115457[U]

[51] Int. Cl.[3] ..... B65H 19/00

[52] U.S. Cl. ..... 242/55.53; 242/138

[58] Field of Search ..... 242/55, 55.2, 55.53, 242/129.6, 129.62, 137–138; 206/389, 408; 225/46–48

[56] References Cited

U.S. PATENT DOCUMENTS 2,322,456 6/1943 Krueger ..... 242/55.53

2,322,950 6/1943 Madsen ..... 242/55.53 X

*Primary Examiner*—Leonard D. Christian

*Attorney, Agent, or Firm*—Birch, Stewart, Kolasch & Birch

[57] ABSTRACT

A facsimile device or an electrophotographic copying machine includes a paper feeding section for supplying a copy paper derived from a roll-paper to an image forming section. A housing of the facsimile device or the electrophotographic copying machine includes a rotatable cover for exposing the paper feeding section when required. A pair of first supporting members are secured to the both side ends of the paper feeding section for rotatably and demountably supporting the roll-paper. A pair of second supporting members are secured to the rotatable cover for preliminarily supporting the roll-paper when the rotatable cover is opened. The roll-paper preliminarily supported by the second supporting members is transferred to the first supporting members when the rotatable cover is closed.

4 Claims, 3 Drawing Figures

ROLL-PAPER SETTING MECHANISM

BACKGROUND AND SUMMARY OF THE INVENTION

The present invention relates to a roll-paper setting mechanism in a facsimile system or in an electrophotographic copying machine.

The roll-paper is frequently used, for the copy paper, in a facsimile system or in an electrophotographic copying machine. The roll-paper must be set at a predetermined position in order to ensure an accurate paper supply. However, the roll-paper setting operation is not easy because the roll-paper is considerably heavy and the roll-paper shaft supporting mechanism is enclosed by a housing of the facsimile system or the electrophotographic copying machine.

Accordingly, an object of the present invention is to provide a novel roll-paper setting mechanism for ensuring an accurate setting of a roll-paper.

Another object of the present invention is to facilitate an exchange of the roll-paper in a facsimile system or in an electrophotographic copying machine.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a portion of a housing of a facsimile system or an electrophotographic copying machine is rotatably constructed to expose a paper feeding mechanism including a roll-paper support mechanism. A preliminary support mechanism is secured to the rotatable portion of the housing for preliminarily supporting the roll-paper. The preliminary support mechanism is correlated with the roll-paper support mechanism so that the roll-paper, preliminarily supported by the preliminary support mechanism, is transferred to and accurately supported by the roll-paper support mechanism when the rotatable portion of the housing is rotated to enclose the paper feeding mechanism.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
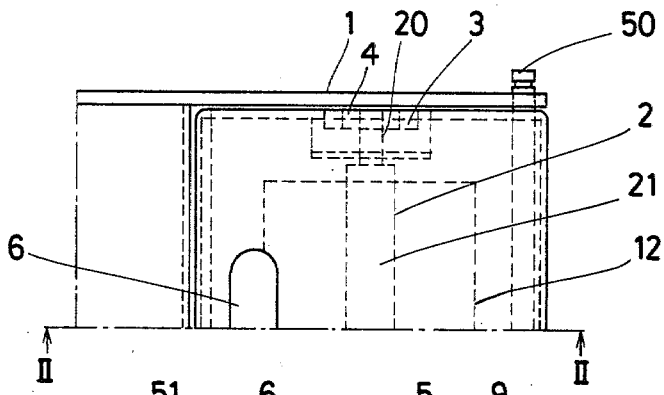
FIG. 1 is a plan view of an essential part of an embodiment of a roll-paper setting mechanism of the present invention.

Referring to FIG. 1, a facsimile device or an electrophotographic copying machine comprises a housing inclusive of a pair (one shown) of side walls 1. A pair (one shown) of first supporting members 3 (roll-paper support mechanism) are secured to the pair of side walls 1, respectively, for supporting a roll-paper shaft 2 which supports a roll-paper 12 wound around a core. The roll-paper shaft 2 comprises a large diameter section 21 for supporting the roll-paper 12, and small diameter sections 20 positioned at both ends of the large diameter section 21. The first supporting member 3 comprises a bearing portion 4 for rotatably supporting the small diameter section 20 of the roll-paper shaft 2. The bearing portion 4 is shaped to have an open upper end through which the roll-paper shaft 2 can be demounted (removed) or set.

Figure 2:
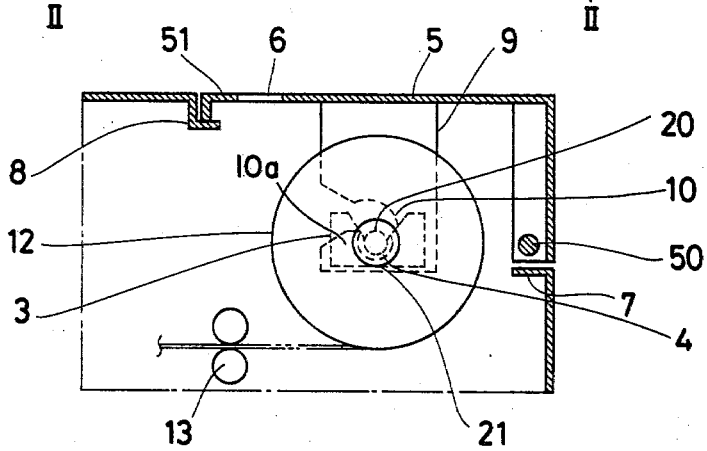
FIG. 2 is a sectional view taken along the line II—II of FIG. 1.
Figure 3:
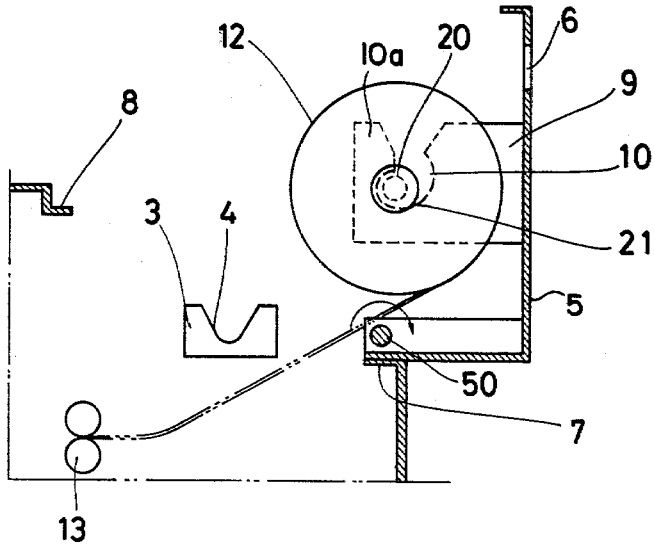
FIG. 3 is a sectional view showing an operation mode of the roll-paper setting mechanism of FIG. 2.

The housing of FIG. 2 includes a cover 5 which is rotatable around a shaft 50 in order to expose the paper feeding section. Near the end 51 of the cover 5, an opening 6 is formed to facilitate the opening operation of the cover 5. FIG. 3 shows a condition where the cover 5 is opened. The housing includes an angled portion 7 which supports the cover 5 when the cover 5 is opened to exchange the roll-paper 12 or to repair the paper feeding section. The housing further includes an angled portion 8 which supports the cover 5 when the cover 5 is closed.

A pair (one shown) of second supporting members 9 (preliminary support mechanism) are secured to the cover 5 for supporting the roll-paper shaft 2 at the smaller diameter sections 20 when the cover 5 is opened. The second supporting member 9 includes a two-stage shaft supporter 10. The two-stage shaft supporter 10 is shaped so that the roll-paper shaft 2 is stably supported thereon when the cover 5 is open (first stage) and when the cover 5 is rotated to close the cover (second stage), the roll-paper shaft 2 is shifted to the first supporting members 3. That is, the two-stage shaft supporter 10 has a bearing portion which has a diameter greater than the bearing portion 4 of the first supporting member 3 and when the cover means is closed the bearing portion of support 10 is below the bearing portion 4 of support 3. During the closing of the cover 5, the roll-paper shaft 2 is retained within the bearing portion of the member 9 by the edge 10*a* of support 10.

When the roll-paper 12 is used up, the roll-paper 12 must be exchanged for a new one. The cover 5 is opened, and the roll-paper shaft 2 is demounted or removed from the apparatus. The roll-paper shaft 2 is inserted into the core of a new roll-paper 12 and, then, the roll-paper shaft 2 is set into the two-stage shaft supporters 10 of the second or preliminary support members 9.

Thereafter, the leading edge of the roll-paper 12 is drawn out and set into a pair of paper feed rollers 13 as shown in FIG. 3. After completion of the preliminary setting of the roll-paper, the cover 5 is closed. The roll-paper 12 preliminarily supported by the second supporting members 9 is transferred to and supported by the first supporting members 3.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A roll-paper setting mechanism for setting a roll-paper in the paper feeding section of a housing having a pair of side walls of an associated apparatus which comprises:

a first supporting means fixed to said housing of said paper feeding section comprising a first bearing portion having an open upper end formed in said first supporting means for rotatably supporting a roll-paper shaft;

a cover means rotatably secured to said housing above said paper feeding section;

a second supporting means fixed to said cover means at a position corresponding to said first supporting means, said second supporting means comprising a second bearing portion formed therein for preliminarily supporting said roll-paper shaft when said cover means is in an open or raised position and which transfers said roll-paper shaft, preliminarily supported by said second bearing portion, to said first bearing portion when said cover means is in a down or closed position, such that when said cover means is in said closed position the second bearing portion is located below the first bearing portion.

2. The roll-paper setting mechanism of claim 1, wherein said first supporting means comprises a pair of support members fixed to the respective side walls of said housing of said paper feeding section.

3. The roll-paper setting mechanism of claim 2, wherein said second supporting means comprises a pair of support members fixed to said cover means at positions corresponding to said fixed positions of said first supporting means.

4. The roll-paper setting mechanism of claim 1, 2 or 3, wherein said second bearing portion has a diameter greater than said first bearing portion.

* * * * *